US007535208B2

(12) United States Patent
De Cremoux

(10) Patent No.: US 7,535,208 B2
(45) Date of Patent: May 19, 2009

(54) CAPACITIVE FEEDBACK CIRCUIT

(75) Inventor: Guillaume De Cremoux, Nijmegen (NL)

(73) Assignee: DSP Group Switzerland AG, Zurich (CH)

( * ) Notice: Subject to any disclaimer, the term of this patent is extended or adjusted under 35 U.S.C. 154(b) by 400 days.

(21) Appl. No.: 10/520,866

(22) PCT Filed: Jun. 25, 2003

(86) PCT No.: PCT/IB03/02724

§ 371 (c)(1),
(2), (4) Date: Jan. 11, 2005

(87) PCT Pub. No.: WO2004/008298

PCT Pub. Date: Jan. 22, 2004

(65) Prior Publication Data

US 2006/0012451 A1 Jan. 19, 2006

(30) Foreign Application Priority Data

Jul. 16, 2002 (EP) ..... 02077856

(51) Int. Cl.
*G05F 1/575* (2006.01)

(52) U.S. Cl. ..... 323/280; 323/277; 327/559

(58) Field of Classification Search ..... 327/535, 327/538, 540, 541, 559; 323/316, 317, 280, 323/277, 273, 275, 279
See application file for complete search history.

(56) References Cited

U.S. PATENT DOCUMENTS 4,223,275 A 9/1980 den Brinker
5,289,109 A * 2/1994 Summe ..... 323/277
5,570,005 A * 10/1996 Hardee et al. ..... 323/314
5,637,992 A * 6/1997 Edwards ..... 323/315
5,867,014 A * 2/1999 Wrathall et al. ..... 323/316
6,084,475 A 7/2000 Rincon-Mora
6,246,221 B1 6/2001 Xi
6,265,856 B1 * 7/2001 Cali' et al. ..... 323/273
6,300,831 B1 10/2001 Xi
6,304,143 B1 10/2001 Corsi
6,329,809 B1 * 12/2001 Dening et al. ..... 324/95
6,404,252 B1 * 6/2002 Wilsch ..... 327/198
6,724,257 B2 * 4/2004 Wrathall ..... 330/253
6,731,164 B2 * 5/2004 Johnston ..... 330/85
6,750,638 B1 * 6/2004 Gang ..... 323/280
7,088,112 B2 * 8/2006 Yakabe ..... 324/658
2003/0178976 A1 * 9/2003 Xi ..... 323/273

OTHER PUBLICATIONS

Sedra and Smith, Microelectronic Circuits, Saunders College Publishing, Third Edition, pp. 298-299, 448, 453-454.*

* cited by examiner

*Primary Examiner*—Akm E Ullah
*Assistant Examiner*—Harry Behm
(74) *Attorney, Agent, or Firm*—Venable LLP; Michael A. Sartori; Jeffri A. Kaminski

(57) ABSTRACT

An improved capacitive feedback circuit (20) comprises a feedback capacitor (23) having its output terminal connected to a high-impedance node (N). More particularly, the improved capacitive feedback circuit comprises a first branch (24) having a bias current source (25), an amplifying element (26), and a current sensor (27) connected in series, the amplifying element having a high-impedance control terminal (26*c*). The feedback capacitor (23) has its output terminal connected to said control terminal (26*c*). A current-to-voltage converting feedback loop (28) has a high-impedance output terminal (28*c*) connected to said feedback capacitor output terminal.

15 Claims, 8 Drawing Sheets

CAPACITIVE FEEDBACK CIRCUIT

The present invention relates in general to a capacitor feedback circuit, designed to behave like a capacitor but without certain drawbacks of a real capacitor. The present invention is specifically useful in a linear voltage regulator for use in an electronics device designed for low power consumption, typically battery-powered devices, such as for instance a mobile telephone. Therefore, in the following, the invention will be specifically explained for such application. However, it is noted that this explanatory application is not to be understood as limiting the use of the present invention, as the present invention can be used in various applications.

Generally speaking, a linear voltage regulator is a device capable of converting a primary supply voltage, which may exhibit noise and/or voltage fluctuations, into a secondary supply voltage which is substantially free from noise and voltage fluctuations, the secondary voltage level being ideally independent of load impedance, so that the secondary voltage can be used as input supply voltage for electronic components such as integrated circuits (ICs) in an electronics device.

FIG. 1A schematically illustrates the general design of a voltage regulator 10, having an input terminal 11 for receiving an input supply voltage $V_{IN}$, and an output terminal 12 for providing stabilized output voltage $V_{OUT}$. The regulator 10 comprises a controllable current transfer means 13, illustrated as a FET having a first terminal 13*a* connected to input 11 and a second terminal 13*b* connected to output 12, for providing the required output current from the input voltage. Said current transfer means 13 has a control terminal 13*c* receiving a control signal from an operational amplifier 14, which generates its output signal on the basis of a comparison between the output voltage $V_{OUT}$ and a stable reference voltage $V_{REF}$, for instance a band gap. In the example as shown, when the FET is implemented as n-type (e.g. NMOS), the amplifier 14 has a non-inverting input 14*a* connected to reference voltage $V_{REF}$, and an inverting input 14*b* coupled to the output terminal 12 through a feedback loop 15, comprising two resistors 15*a* and 15*b* connected in series. If the output voltage drops, due to increased output current consumption, the amplifier 14 will control said current transfer means 13 to increase the current towards the output.

A set of ICs to be powered by the stabilized output voltage $V_{OUT}$ are indicated at 16, representing a load for the regulator 10.

Generally, the regulator is a general purpose regulator, intended for use in many different applications, so that the number of circuits to be powered, as well as their type, depends on the actual application and is not known beforehand. In that case, the load impedance may vary. In any case, during operation, the amount of current drawn by the load may vary, which implies that the effective impedance of the load may vary. As is typical for devices comprising a feedback loop, they are sensitive to the output load impedance in that resonance may occur. Therefore, in order to assure stability of the regulator, a load capacitor 17A is connected to the output 12. As is clear to a person skilled in the art, this load capacitor 17A should define a dominant pole in the frequency characteristic of the regulator, so the capacitive value as seen by the output 12 should be relatively large.

For implementing the load capacitor, there are basically two options. A first option is to connect an external capacitor to the output 12, as illustrated in FIG. 1A. This option has some disadvantages. For a correct functioning of the regulator, the external capacitor should have a value specified by the manufacturer of the regulator, but in practice it is the user who will select the capacitor; also, availability of the capacitor having the specified value might be a problem. Further, capacitors have a parasitic resistance, which may vary from capacitor type to capacitor type, and the stability of the regulator is sensitive to the resistance value of the external capacitor.

Therefore, an alternative option is to use an internal capacitor integrated in the regulator chip. This solution is illustrated in FIG. 1B, which is similar to FIG. 1A, but external load capacitor 17A has been replaced by an internal load capacitor 17B connected between the output terminal 12 and the feedback input terminal 14*b* of the comparator 14.

A problem associated with internal capacitors integrated in a chip is the fact that a capacitor occupies a relatively large chip area, proportional to the capacitive value of the capacitor. This problem is mitigated by the well-known Miller-effect; briefly stated, the feedback capacitor 17B has an effective capacity equal to its intrinsic capacitive value multiplied by the gain of the loop connected in parallel from its output to its input, i.e., in the illustration of FIG. 1B, the gain of amplifier 14 in combination with the gain of the transfer means (FET) 13.

The above-explained alternative solution of FIG. 1B is known per se, for instance from U.S. Pat. No. 6,084,475. This publication shows a design of an amplifier having two subsequent amplifier stages and an intermediate node between said two stages, and a feedback capacitor coupled between the amplifier output and said intermediate node.

The feedback capacitor 17B can be considered as a capacitive device having an input $17B_{IN}$ connected to output 12 and having an output $17B_{OUT}$ connected to a node within the amplifier 14 of the voltage regulator. Its capacitive behavior as seen at its input implies that the feedback capacitor 17B converts an AC input voltage to an AC output current, thus providing AC current feedback. A disadvantage of the design shown in said U.S. Pat. No. 6,084,475 is that the output terminal of the feedback capacitor is connected to a low-impedance node, more particularly the drain and gate of an NMOS FET connected as diode configuration, so that part of the feedback current generated by the feedback capacitor is lost to mass through this NMOS FET. Thus, for obtaining a desired effective feedback current, the feedback capacitor still has to be relatively large. Another disadvantage of the design shown in said U.S. Pat. No. 6,084,475 relates to the fact that said NMOS FET is connected to a second NMOS FET in a current mirror configuration, and receives a bias current at its drain terminal. In order to charge the total gate capacitance of the mirror, an increased bias current is necessary, which is disadvantageous with a view to power consumption and dissipation. Further, part of the feedback current generated by the feedback capacitor is lost to mass.

It is a general aim of the present invention to provide an improved capacitive feedback circuit in which the feedback current is used more efficiently.

According to an important aspect of the present invention, an improved capacitive feedback circuit comprises a feedback capacitor having its output terminal connected to a high-impedance node. Preferably, the impedance at this node is at least 10 MΩ.

In a preferred embodiment, the improved capacitive feedback circuit comprises a first branch having a bias current source, an amplifying element, and a current sensor connected in series, the amplifying element having a high-impedance control terminal. The feedback capacitor has its output terminal connected to said control terminal. A current-to-voltage converting feedback loop has a high-impedance output terminal connected to said control terminal.

These and other aspects, features and advantages of the present invention will be further explained by the following description of a preferred embodiment of the capacitive feedback circuit according to the present invention with reference to the drawings, in which same reference numerals indicate same or similar parts, and in which:

FIGS. 1A and 1B schematically illustrate prior art voltage regulators;

FIG. 2 schematically illustrates a capacitive feedback circuit according to the present invention;

FIG. 3 schematically illustrates a detailed implementation of the capacitive feedback circuit of FIG. 2;

FIG. 4A-C schematically illustrate prior art input stages of a differential amplifier;

FIG. 4D schematically illustrates an input stage of a differential amplifier according to the present invention;

FIG. 5A schematically illustrates a prior art output driver;

FIG. 5B is a simplified representation of the prior art output driver;

FIG. 5C schematically illustrates a prior art output driver;

FIG. 5D schematically illustrates a prior art output driver;

Figure 1B:
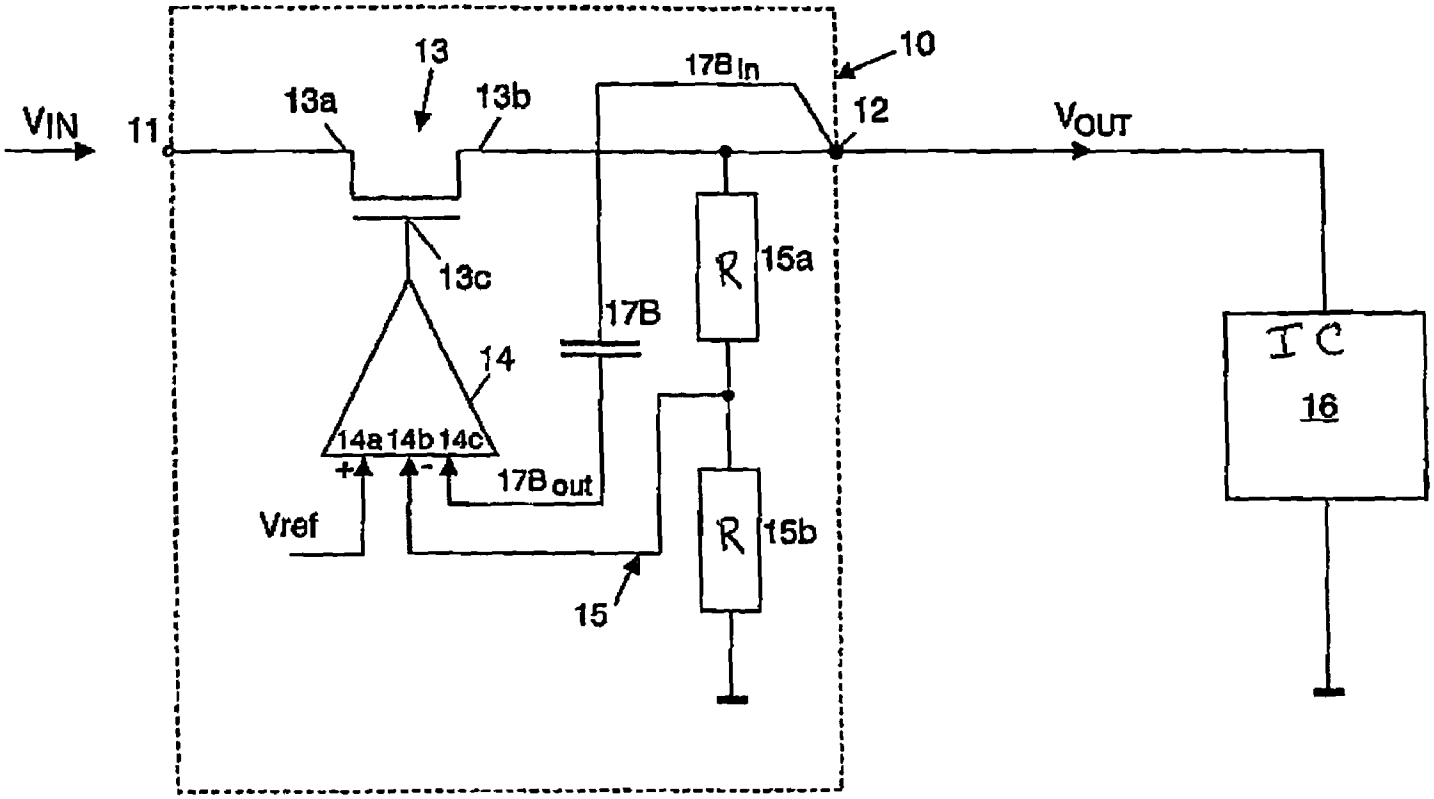
FIG.1B Prior Art
Figure 2:
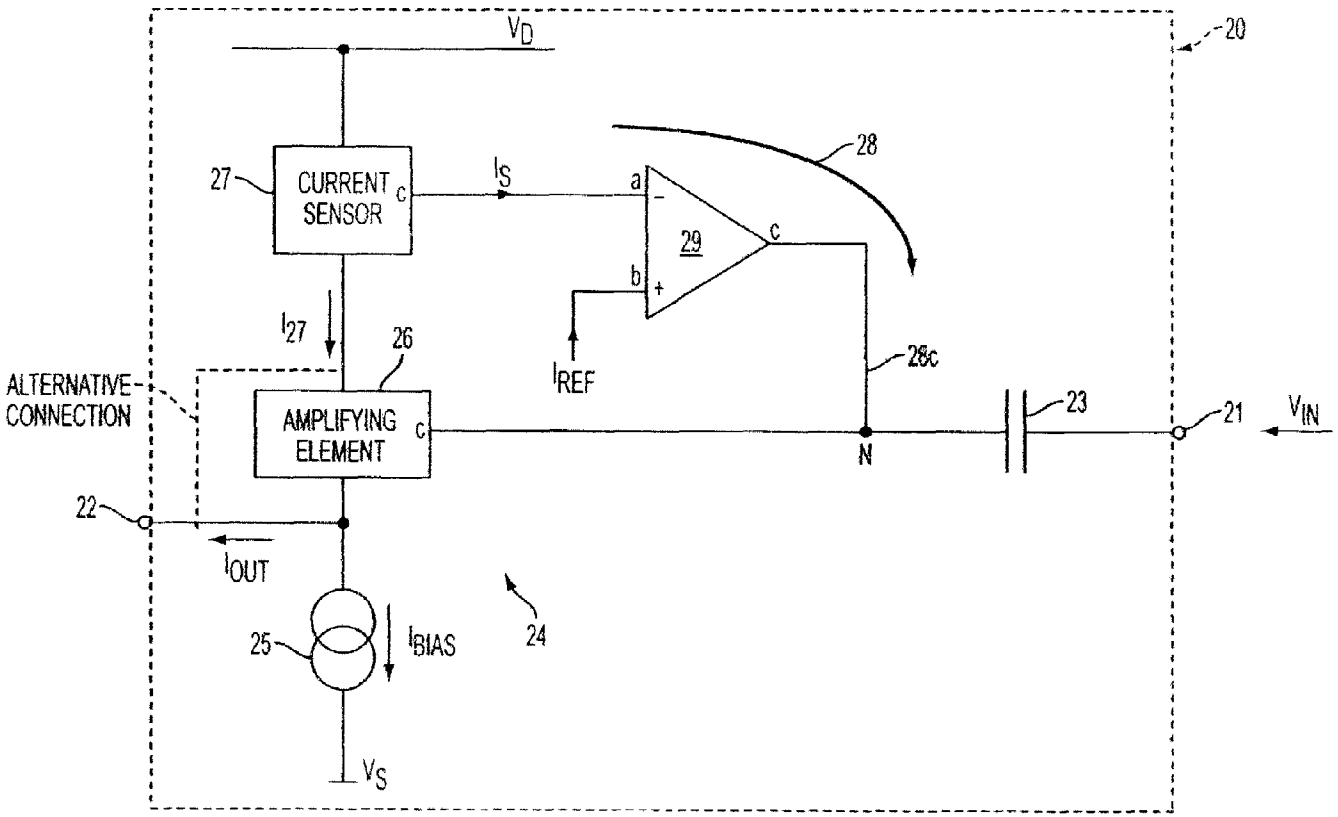

FIG. 2 schematically illustrates a capacitive feedback circuit according to the present invention, generally indicated by reference numeral 20, having a voltage input terminal 21 and a current output terminal 22. This circuit 20 can be used to replace the feedback capacitor 17B illustrated in FIG. 1B. Capacitive feedback circuit 20 comprises a feedback capacitor 23, having a first terminal connected to input 21 and having a second terminal connected to a high-impedance node N. Preferably, the impedance at this node is at least 10 MΩ. Assume that the voltage level at the voltage input 21 is raised: this will cause an output current from capacitor 23 to flow into node N; due to the high impedance at node N, this current will result in a rapid increase of the voltage level at node N. Assume that a steady state is reached, i.e. a state where voltages and currents remain constant; in such a steady state, due to the high impedance at node N, the current flowing out of node N (towards an AC ground, i.e. any of the voltage supplies) will be very small, practically zero.

Capacitive feedback circuit 20 further comprises a first branch 24 having a bias current source 25, an amplifying element 26, and a current sensor 27 connected in series between a first supply voltage $V_D$ and a second supply voltage $V_S$ having a lower voltage level than first supply voltage $V_D$. The amplifying element 26 has a high-impedance control terminal 26*c* connected to said node N. The current sensor 27 is part of a current-to-voltage converting feedback loop 28, which has a high-impedance output terminal 28*c* connected to said node N.

The amplifying element 26 is responsive to a varying voltage at its control terminal 26*c* to vary the current in first branch 24 accordingly. This is sensed by the sensor 27, and through the feedback loop 28 a variation in voltage is applied to node N. The feedback loop 28 is designed such that the applied feedback voltage has a variation corresponding to variations in the input voltage at input 21, but having opposite direction, thus counteracting any voltage variation caused at node N by feedback capacitor 23.

In the exemplary embodiment illustrated in FIG. 2, the current sensor 27 has an output 27*c* providing a current output signal $I_S$ which reflects the current $I_{27}$ through sensor 27. The feedback loop 28 comprises an amplifier 29, having an inverting current input 29*a* connected to said current output 27*c* of the current sensor 27, and having a non-inverting input 29*b* connected to receive a reference current $I_{ref}$. The amplifier 29 further has a voltage output 29*c* (high impedance) connected to node N. As an alternative, the current sensor 27 may be a device generating an output voltage signal, and the comparator 29 may be a device receiving input voltages, but the design as described is preferred because the current consumption is typically lower.

In the exemplary embodiment illustrated in FIG. 2, the current sensor 27 is connected between the amplifying element 26 and said first supply voltage $V_D$, whereas the bias current source 25 is connected between the amplifying element 26 and said second supply voltage $V_S$, while the output terminal 22 is connected to the node between the amplifying element 26 and the bias current source 25. In such a case, variations in output current $I_{OUT}$ at output terminal 22 have a sign opposite to the sign of variations in input voltage $V_{IN}$ at input 21, as will be explained as follows.

Again, assume that the voltage level at the voltage input 21 is raised: a resulting increase of the voltage level at node N will cause an increase in current $I_{27}$ and, since the sum of current $I_{27}$ and output current $I_{OUT}$ is equal to the constant bias current $I_{BIAS}$ as determined by bias current source 25, a corresponding decrease in output current $I_{OUT}$. The increased current $I_{27}$ will cause an increased sensor signal $I_S$ received by inverting input 29*a* of comparator 29, causing a lowering of the voltage at node N.

Alternatively, it is also possible that the output terminal 22 is connected to the node between the amplifying element 26 and the current sensor 27; in such a case, variations in output current $I_{OUT}$ at output terminal 22 will have a sign equal to the sign of variations in input voltage $V_{IN}$ at input 21, as will be clear to a person skilled in the art.

Also, it is possible that the current sensor 27 is connected between the amplifying element 26 and said second supply voltage $V_S$, whereas the bias current source 25 is connected between the amplifying element 26 and said first supply voltage $V_D$, while the output terminal 22 is connected to one terminal of the amplifying element 26, as will be clear to a person skilled in the art.

Figure 3:
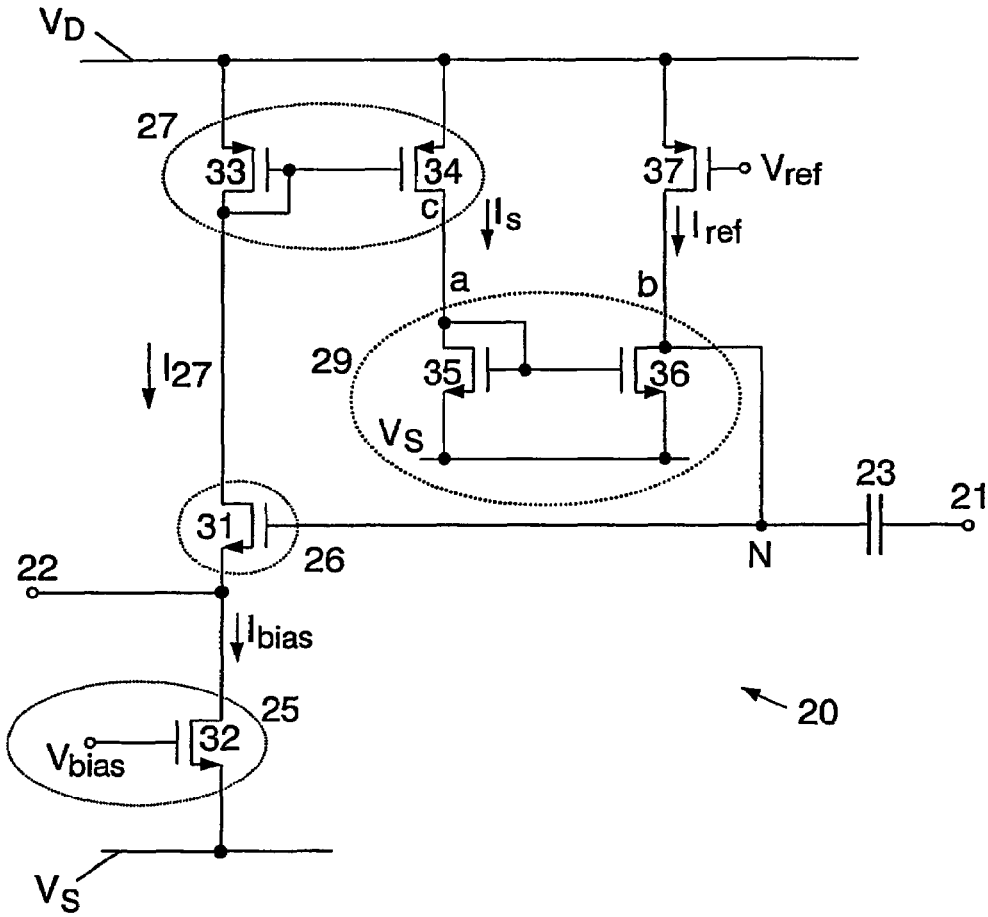

FIG. 3 is a diagram showing in more detail an exemplary embodiment of the capacitive feedback circuit 20 of FIG. 2, suitable for implementation as an integrated circuit.

In the exemplary embodiment of FIG. 3, the amplifying element 26 is implemented as a first NMOS transistor 31 having its source connected to output terminal 22, and having its gate connected to said node N. It is noted that the amplifying element 26 may be implemented by a transistor of other type, for instance a bipolar transistor, but a MOSFET is preferred in view of the high impedance between gate and source/drain. It is further noted that the gate of first NMOS transistor 31 is not connected to its source or its drain, in order to maintain the high impedance of node N.

In the exemplary embodiment of FIG. 3, the bias current source 25 is implemented as a second NMOS transistor 32 having its source connected to second supply voltage $V_S$, having its drain connected to output terminal 22, and having its gate connected to a source of accurate constant bias voltage $V_{BIAS}$.

In the exemplary embodiment of FIG. 3, the current sensor 27 is implemented as a combination of two PMOS transistors 33, 34 connected in a current mirror configuration. More particularly, the current sensor 27 comprises a third PMOS transistor 33 having its source connected to first supply voltage $V_D$ and having its drain connected to the drain of the first NMOS transistor 31, and further comprises a fourth PMOS transistor 34 having its source connected to first supply voltage $V_D$ and having its gate connected to the gate and to the drain of third PMOS transistor 33. The drain of the fourth PMOS transistor 34 acts as output terminal 27*c* of the current sensor 27. Any current $I_{27}$ flowing in the source-drain path of the third PMOS transistor 33 will cause an equal or proportional current $I_S$ flowing in the source-drain path of the fourth PMOS transistor 34.

In the exemplary embodiment of FIG. 3, the amplifier 29 is implemented as a combination of two NMOS transistors 35, 36 connected in a current mirror configuration. More particularly, the amplifier 29 comprises a fifth NMOS transistor 35 having its source connected to second supply voltage $V_S$ and having its drain connected to the drain of the fourth PMOS transistor 34, and further comprises a sixth NMOS transistor 36 having its source connected to second supply voltage $V_S$ and having its gate connected to the gate and to the drain of fifth NMOS transistor 35. The drain of the sixth NMOS transistor 36 acts as output terminal 29*c* of the comparator 29, and is connected to said node N. The drain of the sixth NMOS transistor 36 also acts as the non-inverting input 29*b* of the amplifier 29, and receives a reference current $I_{ref}$ from a reference current source 37, which in this embodiment is implemented as a seventh PMOS transistor 37 having its source connected to first supply voltage $V_D$ and having its drain connected to the drain of the sixth NMOS transistor 36, and having its gate connected to a source of accurate constant reference voltage $V_{ref}$.

Figure 1A:
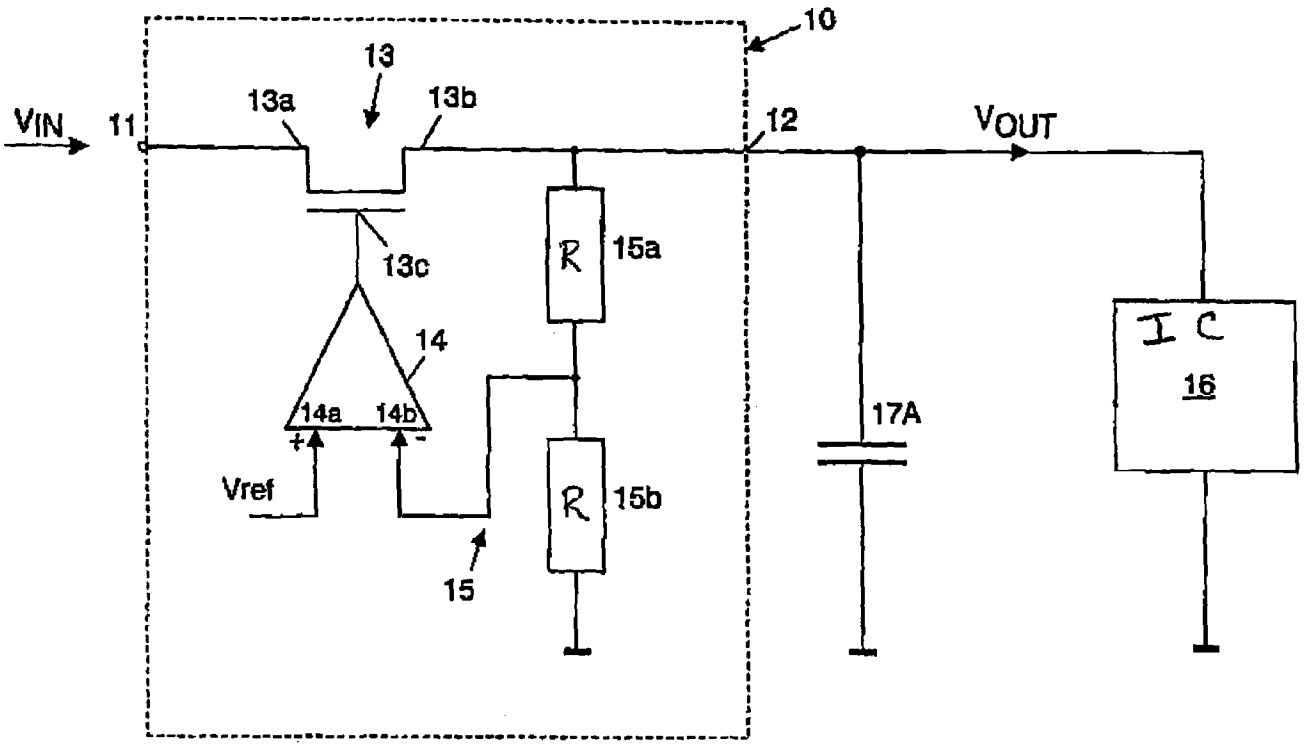
FIG. 1A Prior Art

The present invention further relates to an input stage of a differential amplifier or comparator, such as the amplifier 14 of FIG. 1A, receiving input voltage signals. Such input stage usually comprises two MOSFETs connected in parallel, having their sources coupled together, their respective gates constituting respective input terminals of the input stage. Sometimes it may be desirable that, in equilibrium, the gain of the differential stage is relatively low. To that end, it is known to degenerate the MOSFETs by including resistors in their source paths. A disadvantage of such prior art solution is, however, that the response speed is decreased, resulting in a bad AC behavior, especially a bad transient response.

According to the invention, this problem is eliminated or at least reduced by arranging a non-linear resistor connecting the two sources of the two MOSFETs. Advantageously, this non-linear resistor may be implemented as a MOSFET biased to a constant gate voltage, as will be explained in the following with reference to FIGS. 4A-D.

Figure 4A:
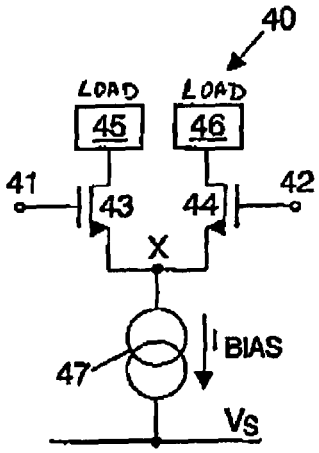

FIG. 4A schematically illustrates part of a prior art input stage 40 of a differential amplifier, having a first voltage input terminal 41 and a second voltage input terminal 42. The input stage 40 comprises a first NMOS transistor 43 and a second NMOS transistor 44 having their sources connected together at a node X, and having their drains connected to respective loads 45, 46. A common bias current source 47, providing a bias current $I_{BIAS}$, is connected between said node X and a voltage reference $V_S$. The transistors 43, 44 have their drains connected to respective loads 45, 46. Alternatively, embodiments with PMOS transistors are also possible, as will be clear to a person skilled in the art.

Figure 4B:
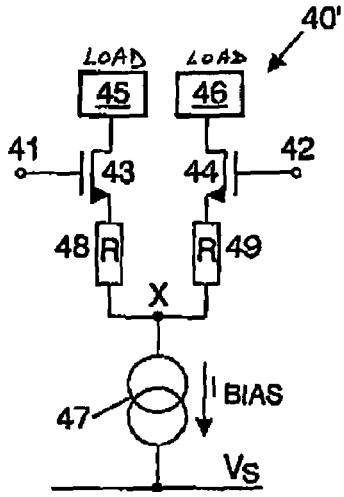

FIG. 4B schematically illustrates a similar part of a prior art input stage 40' of a differential amplifier, where the sources are degenerated by taking up respective resistors 47, 48 between said NMOS transistors 43, 44 and said node X in order to reduce the gain. The two respective resistors 48, 49 have identical resistance R.

Figure 4C:
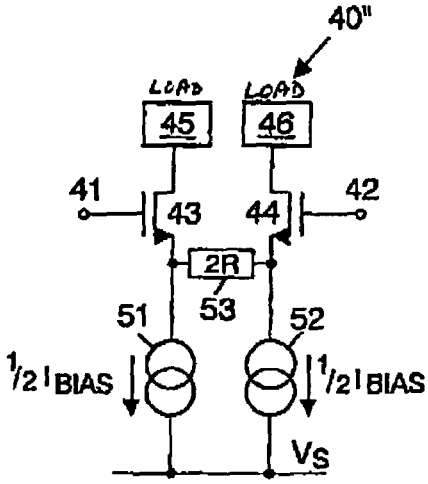

FIG. 4C schematically illustrates a similar part of a prior art input stage 40" of a differential amplifier, which has an equivalent behavior as the prior art input stage 40' of FIG. 4B, but now the two NMOS transistors 43, 44 are connected to respective current sources 51 and 52, and a resistor 53 connects the two sources of the two transistors. The two current sources 51, 52 provide identical bias current $I_{BIAS}/2$. The resistor 53 has the double resistance 2R.

As long as the input stage 40" is in equilibrium, the stage functions satisfactorily. However, if the input stage 40" is out of equilibrium, i.e. a relatively large voltage difference is present between the two inputs 41 and 42, the response of the stage is slow due to the reduced gain.

Figure 4D:
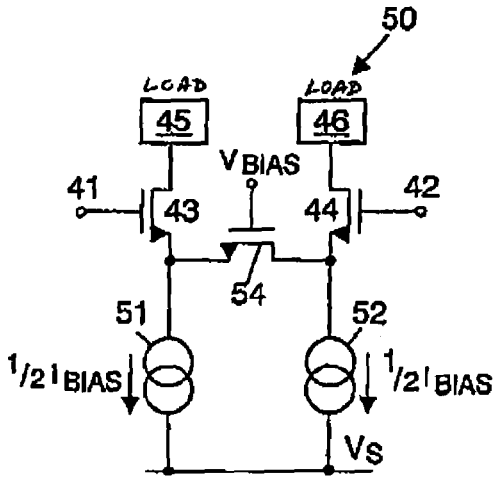

FIG. 4D schematically illustrates a similar part of a input stage 50 of a differential amplifier, which has been improve according to the present invention in that the fixed resistor 53 has been replaced by a non-linear resistor 54. In the preferred embodiment shown, this non-linear resistor 54 is implemented as a third NMOSFET biased to a constant gate voltage. More particularly, NMOSFET 54 has its source connected to the source of the first NMOS transistor 43, has its drain connected to the source of the second NMOS transistor 44, and has its gate connected to a constant bias voltage $V_{BIAS}$, for instance provided by a band gap source, as will be clear to a person skilled in the art.

In equilibrium, the input stage 50 according to the present invention behaves like the input stage 40" of FIG. 4C. If a voltage difference between the drain and source terminals of the third NMOSFET 54 is relatively small, the third NMOSFET 54 generates a current proportional to the voltage drop, i.e. behaves like a resistor with constant resistance. If a voltage difference between the drain and source terminals of the third NMOSFET 54 is relatively large, such as for instance may occur in the case of a transient at one of the inputs, the third NMOSFET 54 generates a more than proportionally large current, i.e. has a reduced resistance, such that the input stage 50 behaves more like the input stage 40 of FIG. 4A, having an increased gain. Thus, the input stage will return to equilibrium state as quick as possible. Experiments show that it is possible to recover the target value of the output voltage with a precision of 5% or better within only 1 μs.

The present invention further relates to an output driver stage of a voltage regulator. In practice, the voltage regulator is used to power device like ICs, of which the current consumption may vary during operation. In many cases, an increased load current may result in a decrease of the equivalent load resistance, which in turn results in a displacement of the dominant pole in the frequency characteristic of the regulator, which is undesirable. Another effect is that the gain of the last stage may be decreased. The present invention proposes a solution to these problems by increasing the gain of the output stage in situations with increased output current, such that the gain of the FET driver is increased when the gain of the output stage decreases and the overall gain is maintained at a substantially constant level. To this end, the present invention proposes to provide the output stage with an output current sensor, and to feedback the sensed current to an input side of the output stage as a control for the gain of the amplifier, such that an increased output current corresponds to an increased gain as will be explained hereinafter with reference to FIGS. 5A-B.

Figure 5A:
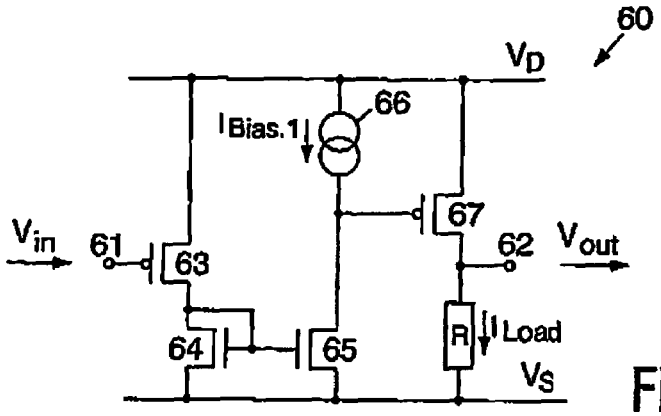
FIG.5A Prior Art
FIG. 5E is a simplified diagram schematically illustrating an output driver according to the present invention.
FIG. 5F illustrates an exemplary embodiment of the output driver according to the present invention.

FIG. 5A schematically illustrates a prior art design for an output driver stage 60 of a voltage regulator, the driver stage 60 having a voltage input terminal 61 and a voltage output terminal 62. The driver stage 60 comprises a first PMOS transistor 63 having its source connected to a first supply voltage level $V_D$, and having its gate connected to the input terminal 61. The driver stage 60 further comprises two NMOS transistors connected in current mirror configuration.

More particularly, a second NMOS transistor 64 has its source connected to a second supply voltage level $V_S$, and has its drain connected to the drain of the first PMOS transistor 63. A third NMOS transistor 65 has its source connected to said second supply voltage level $V_S$, has its drain connected to a first bias current source 66 coupled to said first supply voltage level $V_D$ for generating a first bias current $I_{BIAS.1}$, and has its gate connected to the gate and to the drain of the second NMOS transistor 64. The driver stage 60 further comprises a fourth or output PMOS transistor 67 having its source connected to said first supply voltage level $V_D$, having its gate connected to the drain of the third NMOS transistor 65, and having its drain connected to the output terminal 62. An output load is indicated as a resistor R, drawing an output current $I_{LOAD}$. In the example shown, the driver stage 60 is implemented as an inverting stage.

An increase of the input voltage at input 61 will reduce the current through first transistor 63, which is reflected by a similar reduction in the current through third transistor 65. Thus, a larger part of the bias current $I_{BIAS.1}$, will flow towards the gate of output transistor 67, resulting in a lowering of the output voltage at output 62.

Figure 5B:
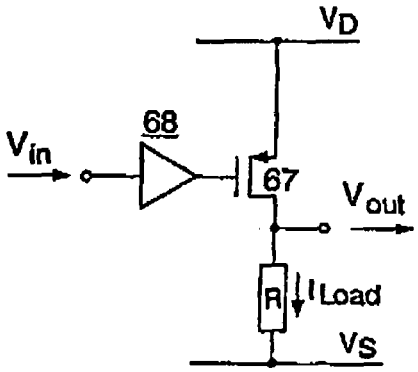
FIG.5B Prior Art

FIG. 5B is a simplified representation of the prior art output driver 60, in which the output transistor 67 is shown as being driven by an amplifier 68. In the following, the gain of this amplifier 68 will be indicated as $\alpha$, whereas the gain of the output transistor 67 will be indicated as $\gamma$. Thus, the amplifier 68 provides at the gate of the output transistor 67 a gate voltage $\alpha V_{IN}$. The output transistor 67 provides an output current $I_{LOAD}=\alpha\cdot\gamma\cdot V_{IN}$. Depending on the load impedance R, the output voltage $V_{OUT}$ will have a value $R\cdot\alpha\cdot\gamma\cdot V_{IN}$. In other words, the voltage gain of the output driver 60 can be expressed as $V_{OUT}/V_{IN}=R\cdot\alpha\cdot\gamma$.

In a regulator, the output voltage $V_{OUT}$ should be constant. Then, if the current consumption of the load increases, the product $R\cdot\gamma$ will decrease. More particularly, such product is substantially proportional to the inverse square root of $L_{LOAD}$. Such decrease will affect the closed loop regulation characteristic.

Figure 5C:
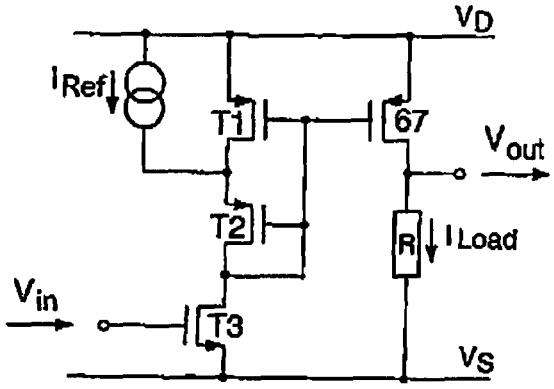
FIG.5C Prior Art

FIG. 5C illustrates a first type of prior art attempt to provide a solution to this problem by tuning amplifier 68, as described for instance by R. Antheunis et al in "Simple Scalable CMOS Linear Regulator Architecture", poster session ESSCIR 2001. The tunable amplifier 68 is implemented by three transistors T1, T2, T3 connected in series, and a current source $I_{REF}$. Two operative conditions will be discussed. If the output current $I_{LOAD}$ is low, the input transistor T3 drives the current flowing through the output transistor 67 via the mirror formed by the output transistor 67 and the first and second transistors T1 and T2. The current flowing through these first and second transistors T1 and T2 is low. The reference current $I_{REF}$ is larger than the current flowing through the second transistor T2, which pinches the first transistor T1. Virtually, only the mirror formed by the output transistor 67 and the second transistor T2 is active.

If the output current $I_{LOAD}$ is high, the current flowing through the first and second transistors T1 and T2 is high. The reference current $I_{REF}$ is absorbed by the first and second transistors T1 and T2, and the first transistor T1 is no longer pinched. The combination of the first and second transistors T1 and T2 can now be regarded as one smaller transistor, and the gain of the circuit constituted by this smaller transistor and the output transistor 67 is increased.

One disadvantage of this prior art approach is that the circuit is a feed-forward circuit. The gain is tuned without having information on the output current $I_{LOAD}$, the method fully relies on the current flowing through the input transistor T3.

Figure 5D:
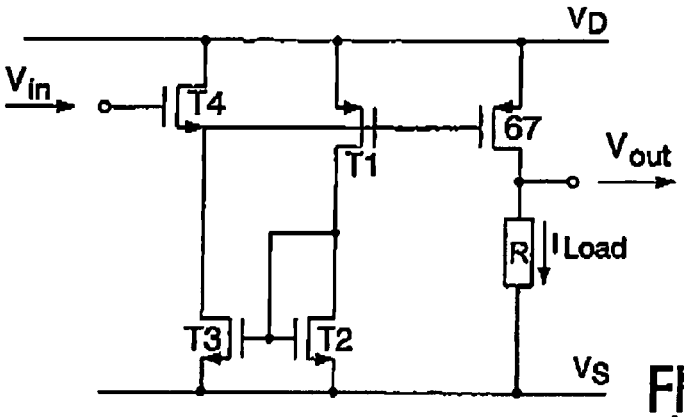
FIG.5D Prior Art

FIG. 5D illustrates a second type of prior art attempt to provide a to the above-mentioned problem, as disclosed for instance in U.S. Pat. No. 5,982,226. However, in fact said problem is not solved; only compensation is provided by increasing the speed at which the output transistor 67 is driven. An input transistor T4 has its source connected to the gate of the output transistor 67, thus driving the output transistor 67. A current sensing transistor T1 (smaller than the output transistor 67) also has its gate connected to the of the source input transistor T4. A third transistor T3 is connected in the source path of the input transistor T4, and is connected to a second transistor T2 to form a current mirror, the second transistor T2 being connected in series with the current sensing transistor T1. Current flowing in the current sensing transistor T1 is mirrored through said second and third transistors T2 and T3, and biases the input transistor T4. As a result, if the output current $I_{LOAD}$ increases, also the current in the branch T3/T4 increases and the large gate capacitance of the output transistor 67 can be charged or discharged more easily.

Figure 5E:
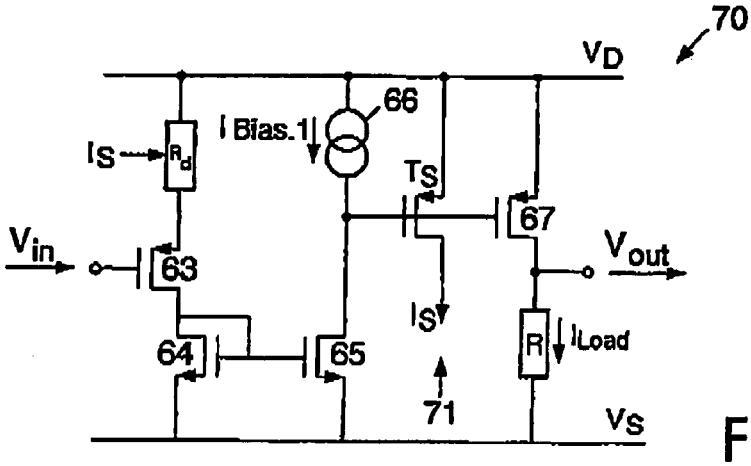

The present invention provides a driver stage which offers a solution to the above-mentioned problem, the solution being based on tuning amplifier 68, as described in the above with reference to the prior art solution of FIG. 5C, but now on the basis of a feedback method instead of the feed-forward method of FIG. 5C. Such inventive driver stage 70 is schematically illustrated in FIG. 5E. The driver stage 70 according to the present invention is comparable to the prior art stage 60, but improved by comprising a current feedback loop 71 which is effective to reduce the impedance in the source line of the input transistor 63 in response to an increase of the load current. In FIG. 5E, this current feedback loop 71 is shown as comprising an output current sensor Ts coupled to the output transistor 67, and a controllable resistance Rd incorporated in the source line of the input transistor 63, this controllable resistance Rd being controlled by an output sense current Is provided by said output current sensor Ts. In the embodiment shown, the output current sensor Ts is implemented as a PMOS transistor having its source and gate connected in parallel to the source and gate of the output transistor 67, so that the source-drain current of this PMOS sensor transistor Ts is equal to or at least proportional to the output current $I_{LOAD}$. Preferably, the output current sensor transistor Ts is sized smaller than the output transistor 67, so that the output sense current Is is smaller than the output current $I_{LOAD}$.

The operation is as follows. If the output current $I_{LOAD}$ is small, the output sense current Is is also small, and the controllable resistance Rd is controlled to a large resistance value. Thus, the input transistor 63 is degenerated by this resistance Rd, and the gain of the input transistor 63 is small. Conversely, if the output current $I_{LOAD}$ is high, the output sense current Is is also high, and the controllable resistance Rd is controlled to a small resistance value. Thus, the degeneration of the input transistor 63 is decreased, and the gain of the input transistor 63 is increased. In a possible embodiment, the resistance value of the controllable resistance Rd is reduced to zero if the output current $I_{LOAD}$ reaches its maximum value.

Thus, if the output current $I_{LOAD}$ increases/decreases, the gain of the input transistor 63 increases/decreases as well, such as to maintain the overall voltage gain $V_{OU}/V_{IN}$ substantially constant.

A further advantage of the driver design proposed by the present invention is that the current flowing through the input transistor 63 is substantially constant. As a result of this, the transconductance of the input transistor 63 will remain substantially constant when the output current $I_{LOAD}$ varies, and the tuning of the gain a only depends on the controllable degeneration resistance Rd.

Figure 5F:
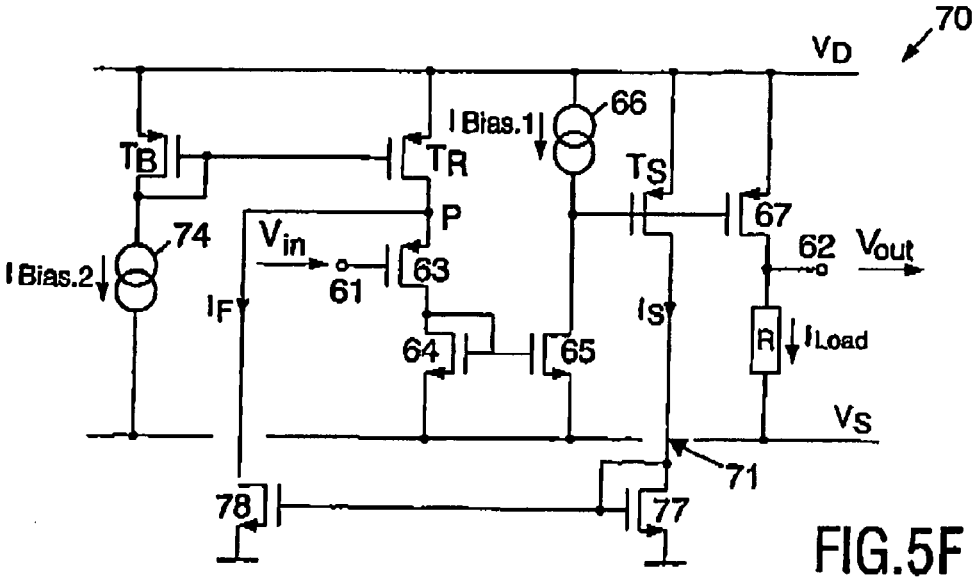

FIG. 5F shows in more detail an exemplary embodiment of the current feedback loop 71 and the controllable resistance Rd. The controllable resistance Rd comprises a resistance transistor $T_R$ incorporated in the source line of the input transistor 63, which is connected to a bias transistor $T_B$ in current mirror configuration. This bias transistor $T_B$ is coupled to a second bias current source 74 generating a second bias current $I_{BIAS.2}$.

More particularly, a PMOS resistance transistor $T_R$ has its source connected to said first supply voltage level $V_D$, and has its drain connected to the source of the input transistor 63. A PMOS bias transistor $T_B$ has its source connected to said first supply voltage level $V_D$, and has its drain connected to said second bias current source 74 which is coupled to said second supply voltage level $V_S$. The gates of the resistance transistor $T_R$ and the bias transistor $T_B$ are connected to each other and to the drain of the bias transistor $T_B$.

The current feedback loop 71 comprises two NMOS transistors 77, 78 connected in current mirror configuration, arranged to mirror the sensor output current $I_S$ towards the source of the input transistor 63. More particularly, an NMOS transistor 77 has its source connected to said second supply voltage level $V_S$ and has its drain connected to the drain of PMOS sensor transistor $T_S$. An NMOS transistor 78 has its source connected to said second supply voltage level $V_S$, has its gate connected to the gate and to the drain of the NMOS transistor 77, and has its drain connected to a node P between the source of input transistor 63 and the drain of resistance transistor $T_R$.

Thus, NMOS transistor 78 draws a feedback current $I_F$ from said node P towards second supply voltage level $V_S$, this feedback current $I_F$ being proportional to the sensor output current $I_S$. If desired, NMOS transistor 78 can be made smaller than NMOS transistor 77, so that the feedback current $I_F$ can be smaller than the sensor output current $I_S$.

If the output current $I_{LOAD}$ is small, the output sense current $I_S$ and hence the feedback current $I_F$ are also small. As regarding AC signals, the source of the input transistor 63 "sees" a resistance to AC ground (i.e. any of the supply lines) equal to the resistance of resistance transistor $T_R$ (which is substantially constant) in parallel to the resistance of NMOS transistor 78 (which is very high because NMOS transistor 78 operates in linear mode).

If the output current $I_{LOAD}$ is high, the output sense current $I_S$ and hence the feedback current $I_F$ are also high. The current flowing through input transistor 63 is substantially constant (being determined by first bias current source 66 and the current mirror 64/65). The resistance of resistance transistor $T_R$ is still substantially constant. The resistance of NMOS transistor 78, however, now is much smaller because of the increased feedback current $I_F$ (R=V/I, wherein V is the Early voltage, which depends on the technology that is used). Hence, the source of the input transistor 63 "sees" a reduced resistance to AC ground.

Figure 6:
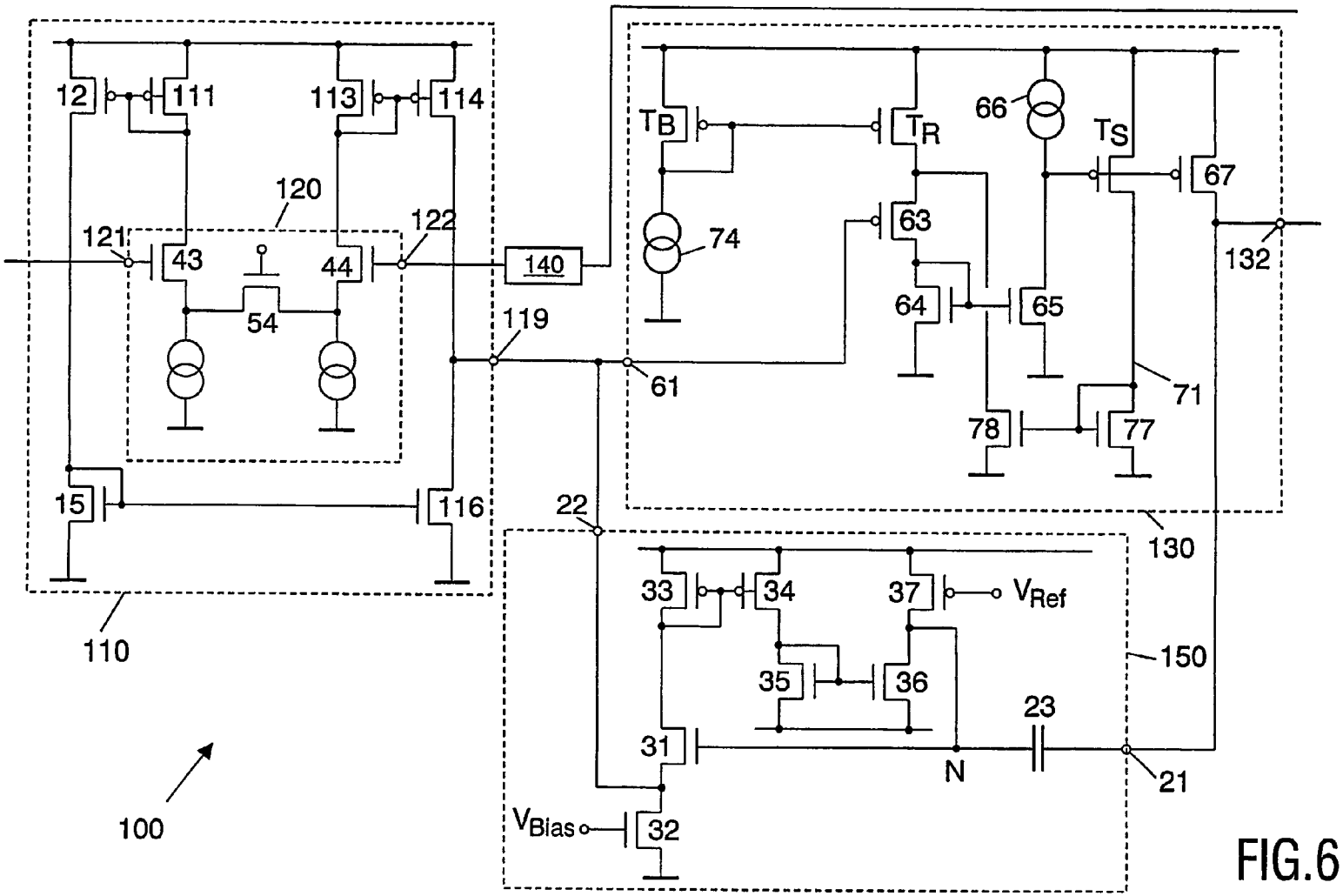
FIG. 6 is a diagram schematically illustrating a voltage regulator according to the present invention.

FIG. 6 schematically shows a circuit diagram of a voltage regulator 100, in which the above-described inventive stages are integrated on one circuit. The voltage regulator 100 has a voltage input terminal 101 and a voltage output terminal 102. An input differential amplifier is generally indicated with reference numeral 110. An input stage, as described above with reference to FIG. 4D, is generally indicated with reference numeral 120. A signal input terminal 121 of this input stage 120, connected to the regulator input terminal 101, connects to the gate of first input transistor 43, and a voltage feedback input terminal 122 connects to the gate of second input transistor 44. The drain of first NMOS input transistor 43 is connected to the drain of a third PMOS input transistor 111, connected together with a fourth PMOS input transistor 112 in a current mirror topology. The drain of second NMOS input transistor 44 is connected to the drain of a fifth PMOS input transistor 113, connected together with a sixth PMOS input transistor 114 in a current mirror topology. The drain of fourth PMOS input transistor 112 is connected to the drain of a seventh NMOS input transistor 115, connected together with an eighth NMOS input transistor 116 in a current mirror topology. The drain of sixth PMOS input transistor 114 is connected to the drain of eighth NMOS input transistor 116, and this node is an output node 119 of the input differential amplifier 110.

An output driver stage, as described above with reference to FIG. 5F, is generally indicated with reference numeral 130. The input terminal 61 of the output driver stage 130 is connected to the output node 119 of the input differential amplifier 110.

A voltage feedback circuit, comprising a resistive voltage divider and represented here as a resistor 140, has its input terminal connected to output terminal 132 of the output driver stage 130, and has its output terminal connected to the feedback input terminal 122 of the input stage 120 of the input differential amplifier 110, in order to feed back towards the input of voltage regulator 100 a voltage signal representing the output voltage $V_{OUT}$ of voltage regulator 100.

A capacitive feedback circuit, as described above with reference to FIG. 3, is generally indicated with reference numeral 150. This capacitive feedback circuit has its input terminal 21 connected to output terminal 132 of the output driver stage 130, and has its output terminal 22 connected to the input terminal 61 of driver stage 130, in order to feed back towards the input of driver stage 130 a current signal representing the output voltage of voltage regulator 100. In this respect, it is noted that voltage regulator 100 has a two-stage design, comprising an input stage 110 and an output stage 130, and that the current feedback loop implemented by capacitive feedback circuit 150 is coupled to an inter-stage node 119/61 between said two stages. It can be proven that such design provides better stability.

It should be clear to a person skilled in the art that the present invention is not limited to the exemplary embodiments discussed above, but that various variations and modifications are possible within the protective scope of the invention as defined in the appending claims.

The invention claimed is:

1. A capacitive feedback circuit, comprising:

a voltage input terminal;

a current output terminal;

a feedback capacitor, having a first terminal connected to input terminal and having a second terminal connected to a high-impedance node;

a current amplifying element having a high-impedance control terminal connected to said node;

a current sensor connected in series between said current amplify element and a first supply voltage; and a bias current source connected in series between said current amplifying element and a second supply voltage; wherein said current sensor is part of a current-to-voltage converting feedback loop, which has a high-impedance output terminal connected to said node.

2. Capacitive feedback circuit according to claim 1, wherein the current sensor has an output providing a current output signal, and wherein the feedback loop comprises a comparator, having one current input connected to said current output of the current sensor, having a second input connected to receive a reference current, and having a voltage output connected to said node.

3. Capacitive feedback circuit according to claim 2, wherein the current amplifying element comprises a first transistor, having its gate connected to said node.

4. Capacitive feedback circuit according to claim 3, wherein the current sensor comprises a third transistor having its source connected to first supply voltage and having its drain connected to the drain of the first transistor, and further comprises a fourth transistor having its source connected to first supply voltage and having its gate connected to the gate and to the drain of the third transistor.

5. Capacitive feedback circuit according to claim 4, wherein the comparator comprises a fifth transistor having its source connected to second supply voltage and having its drain connected to the drain of the fourth transistor, and further comprises a sixth transistor having its source connected to second supply voltage and having its gate connected to the gate and to the drain of the fifth transistor.

6. Capacitive feedback circuit according to claim 5, wherein the comparator further comprises a reference current source coupled to provide a reference current to the drain of the sixth transistor, and wherein the drain of the sixth transistor is connected to said node.

7. Capacitive feedback circuit according to claim 6, wherein the reference current source a seventh transistor having its source connected to first supply voltage, having its drain connected to the drain of the sixth transistor, and having its gate connected to a source of accurate constant reference voltage.

8. Capacitive feedback circuit according to claim 2, wherein the bias current source comprises a second transistor, having its source connected to second supply voltage, and having its gate connected to a source of accurate constant bias voltage.

9. Capacitive feedback circuit according to claim 2, wherein the current amplifying element comprises a first MOSFET transistor, having a gate connected to said node; wherein the bias current source comprises a second MOSFET transistor, having a source connected to said second supply voltage, and having a gate connected to a source of accurate constant bias voltage; and wherein the second MOSFET transistor has its-a drain connected to the-a source of the first transistor.

10. Capacitive feedback circuit according to claim 2, wherein the comparator comprises a combination of two transistors, connected in a current mirror configuration.

11. Capacitive feedback circuit according to claim 1, wherein the output terminal is connected to a node between the current amplifying element and the bias current source.

12. Capacitive feedback circuit according to claim 1, wherein the output terminal is connected to a node between the current amplifying element and the current sensor.

13. Capacitive feedback circuit according to claim 1, wherein the current sensor comprises a combination of two transistors, connected in a current mirror configuration.

14. Voltage regulator comprising a capacitive feedback circuit according to claim 1.

15. Voltage regulator comprising:

a voltage input terminal;

a voltage output terminal;

an input differential amplifier, comprising a differential input stage which comprises:

a first series arrangement of a first MOSFET transistor and a first current source;

a second series arrangement of a second MOSFET transistor and a second current source;

and a non-linear resistor having a first terminal connected to a first node between the first MOSFET transistor and the first current source and having a second terminal connected to a second node between the second MOSFET transistor and the second current source;

said input differential amplifier having a signal input terminal connected to the regulator input terminal;

an output driver stage comprising:

a voltage input connected to an output of the input differential amplifier;

a voltage output;

a current feedback loop feeding back a signal representative of the output current provided at said voltage output such as to effectively decrease the AC-impedance at said voltage input in order to increase the gain for AC signals;

voltage feedback means having an input connected to the regulator output terminal and having an output connected to a feedback input terminal of the input stage;

and a capacitive feedback circuit according to claim 1, having its input terminal connected to the regulator output terminal and having its output terminal connected to the input of the output driver stage;

wherein said voltage regulator further has one or more of the following features:

(a) the non-linear resistor comprises a third MOSFET transistor, having its source connected said first node, having its drain connected to said second node, and having its gate connected to a constant bias voltage;

(b) the first current source is connected between a source of the first MOSFET transistor and a voltage reference;

the second current source is connected between a source of the second MOSFET transistor and said voltage reference;

and said three transistors mutually are of the same conductivity type;

(c) the output driver stage comprises:

an input MOSFET transistor, having its source connected to a controllable impedance, and having its gate connected to the input terminal; wherein said controllable impedance comprises:

two MOSFET transistors, connected in current mirror configuration, wherein a first one of said transistors has its source connected to a first supply voltage level, and has its drain connected to a bias current source, and wherein a second one of said transistors has its source connected to a first supply voltage level, has its drain connected to the source of the input transistor, and has its gate connected to the gate and to the drain of the said first transistor;

an output MOSFET transistor, having its source connected to a first supply voltage level, and having its drain connected to the output terminal;

current coupling means coupled between the drain of said input transistor and the gate of said output transistor; wherein said current coupling means comprise:

two MOSFET transistors, connected in current mirror configuration, wherein one transistor has its source connected to a second supply voltage level and has its drain connected to the drain of the input transistor, and wherein the other transistor has its source connected to said second supply voltage level, has its drain connected to a first bias current source and to the gate of said output transistor, and has its gate connected to the gate and to the drain of the said one transistor;

an output current sensor associated with the output transistor, providing a sensor output current signal representing the output current; wherein the output current sensor comprises a sensor transistor of the same conductivity type as the output transistor, having its source and gate connected in parallel to the source and gate of the output transistor;

a current feedback loop feeding back a signal derived from the sensor output current signal to control said controllable impedance; wherein the current feedback loop comprises:

two MOSFET transistors, connected in current mirror configuration, wherein one transistor has its drain connected to receive said sensor output current signal and wherein the other transistor has its drain connected to the source of the input transistor.

* * * * *